US010493305B2

(12) United States Patent
Senecal

(10) Patent No.: US 10,493,305 B2
(45) Date of Patent: Dec. 3, 2019

(54) SYSTEM AND METHOD OF CONDITIONING AND DELIVERY OF LIQUID FIRE EXTINGUISHING AGENT

(75) Inventor: Joseph Senecal, Wellesley, MA (US)

(73) Assignee: UTC FIRE & SECURITY CORPORATION, Farmington, CT (US)

( * ) Notice: Subject to any disclaimer, the term of this patent is extended or adjusted under 35 U.S.C. 154(b) by 138 days.

(21) Appl. No.: 14/239,278

(22) PCT Filed: Aug. 19, 2011

(86) PCT No.: PCT/US2011/048409
§ 371 (c)(1),
(2), (4) Date: Feb. 18, 2014

(87) PCT Pub. No.: WO2013/028152
PCT Pub. Date: Feb. 28, 2013

(65) Prior Publication Data
US 2014/0202719 A1 Jul. 24, 2014

(51) Int. Cl.
*A62C 13/68* (2006.01)
*A62C 35/02* (2006.01)

(52) U.S. Cl.
CPC ..... *A62C 13/68* (2013.01); *A62C 35/023* (2013.01)

(58) Field of Classification Search
CPC ..... A62C 35/68; A62C 35/605; A62C 35/02; A62C 35/645; A62C 3/06; A62C 3/00; A62C 3/04; A62C 5/02; A62C 13/68; A62C 13/66; A62C 13/70; A62C 35/023;
(Continued)

(56) References Cited

U.S. PATENT DOCUMENTS 3,830,309 A * 8/1974 Ray ..... A62C 5/002 169/14
4,520,871 A * 6/1985 Miller ..... A62C 3/16 169/43

(Continued)

FOREIGN PATENT DOCUMENTS

EP 1454658 * 8/2004 ..... A62C 31/07
WO WO2010/071622 * 12/2008 ..... A62C 2/00
WO WO 2010/071622 * 12/2008 ..... A62C 2/00

OTHER PUBLICATIONS

Notification of Transmittal of the International Search Report and the Written Opinion of the International Searching Authority, or the Declaration; PCT/US2011/048409; dated Mar. 26, 2012.

*Primary Examiner* — Viet Le
*Assistant Examiner* — Christopher R Dandridge
(74) *Attorney, Agent, or Firm* — Cantor Colburn LLP

(57) ABSTRACT

A system for delivery of a fire extinguishing agent includes an agent tank at least partially filled with a volume of liquid fire extinguishing agent and a supply of pressurizing gas operatively connected to inject pressurizing gas into the volume of liquid agent. A discharge valve is configured to open when the agent tank reaches a desired pressure due to the injection of pressurizing gas therein thereby delivering a flow including fire extinguishing agent with associated dissolved pressurizing gas from the agent tank. The flow of fire extinguishing agent and associated dissolved pressurizing gas is discharged from the agent tank.

28 Claims, 1 Drawing Sheet

(58) Field of Classification Search
CPC ..... A62C 35/026; A62C 35/13; A62C 35/64; A62C 13/003; A62C 13/74; A62C 13/72
USPC .... 169/9, 20, 26, 56, 60, 71, 72, 85, 43, 44, 169/54, 5, 14, 19, 15, 30; 239/398, 432, 239/373
See application file for complete search history.

(56) References Cited

U.S. PATENT DOCUMENTS

| | | | | | |
|---|---|---|---|---|---|
| 6,016,874 | A * | 1/2000 | Bennett | A62C 5/006 | 169/77 |
| 6,131,667 | A * | 10/2000 | Jesadanont | A62C 13/76 | 169/16 |
| 8,973,670 | B2 * | 3/2015 | Enk, Sr. | A62C 3/08 | 169/14 |
| 2002/0027143 | A1 | 3/2002 | Schoenrock et al. | | |
| 2004/0194974 | A1 | 10/2004 | Arnot | | |
| 2005/0001065 | A1 * | 1/2005 | Senecal | A62C 31/02 | 239/461 |
| 2008/0174033 | A1 * | 7/2008 | Duesel | B01D 1/0058 | 261/121.1 |
| 2010/0218961 | A1 | 9/2010 | Lade et al. | | |
| 2012/0168184 | A1 * | 7/2012 | Enk, Sr. | A62C 3/08 | 169/14 |

* cited by examiner

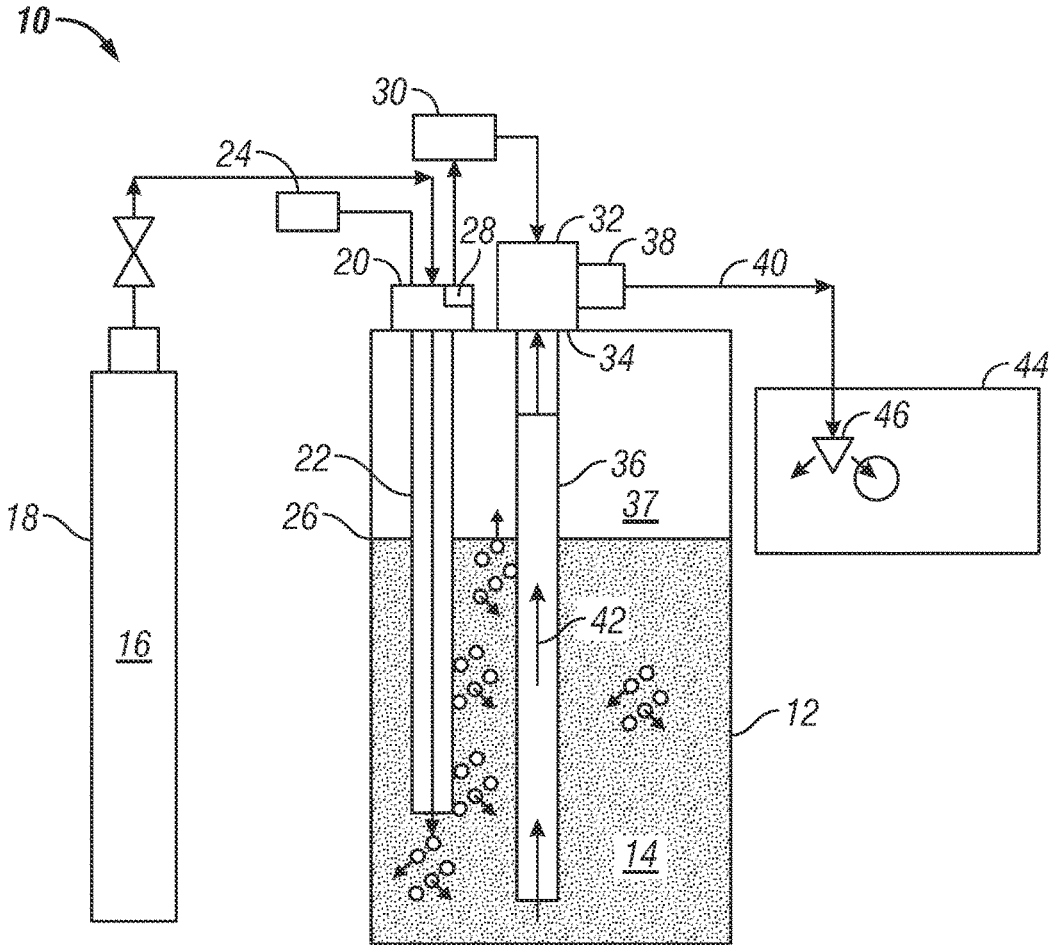
10
30
24
28
32
38
20
40
34
44
46
22
36
37
18
26
42
16
12
14

SYSTEM AND METHOD OF CONDITIONING AND DELIVERY OF LIQUID FIRE EXTINGUISHING AGENT

BACKGROUND OF THE INVENTION

The subject matter disclosed herein relates to fire extinguishing agents and systems. More specifically, the subject disclosure relates to the mixing and dispensing of fire extinguishing agents and propelling gas.

Total-flooding fire-extinguishing systems (FXS) are used to extinguish fires in enclosed protected spaces by creating fire-extinguishing atmospheres therein. A fire-extinguishing atmosphere (FXA) is created by adding a gaseous fire-extinguishant (GFX), also referred to as a gaseous fire-extinguishing agent, to the air in the protected space in sufficient quantity to exceed the minimum extinguishing concentration (MEC) of the GFX for the type of fuel that is burning. Gaseous fire-extinguishants comprise either ordinary gases such as nitrogen, argon, carbon dioxide, and other non-oxidizing gases, or of vaporizing liquids or liquefied compressed gases usually including of one or more chemicals based on carbon and fluorine chemistry such as hydrofluorocarbons, fluoroketones, perfluoroketones, perfluorocarbons, fluoro-olefins, and similar chemicals including those whose chemical structure contains chlorine and bromine. Where a GFX comprises one or more ordinary non-liquefied gases, the agent container is filled uniformly with compressed GFX gas. Where a GFX consists of a liquid or a liquefied compressed gas, the agent container is only partially filled uniformly with GFX leaving an ullage space above the liquid to accommodate pressurized expellant gas. Prior to delivery of the GFX to the protected space the GFX is stored in one or more containers that are either pressurized with an expellant gas or gas mixture which typically includes the gas or vapor of the agent itself plus, as required, additional expellant gas such as nitrogen, argon, carbon dioxide or other pressurized gas. The GFX storage container may be pre-pressurized or pressurized at the time the FXS is called upon to operate to deliver GFX to the protected space. Elements of the FXS necessary to deliver the GFX to the protected space include the GFX storage container and its subcomponents, including a discharge valve; a pipe system, which may be branched, through which the GFX flows from the location of the storage container to one or more points of discharge in the protected space; and a nozzle at each point of discharge to disperse the GFX into the atmosphere of the protected space.

An important measure of performance of a FXS is the maximum delivery length of the pipe system through which the GFX can be conveyed while maintaining at each nozzle a sufficient pressure to assure effective dispersion of the GFX into the protected space. The maximum delivery length in an FXS where the source of propellant gas comprises only that propellant gas contained in a pre-pressurized storage container is relatively limited owing to the reduction of pressure in the storage container during the course of expelling the GFX. In order to project agent through longer pipe systems, more propellant energy, or pressure, is required at the agent container. This can be achieved by simply increasing the amount of propellant gas, usually nitrogen, initially charged to the pre-pressurized agent container, but this approach is limited by the working pressure of the container. In the case of a pre-pressurized GFX container, where the GFX is a liquid or liquefied compressed gas, a portion of the propellant gas added to the ullage space to pre-pressurize the agent container, usually nitrogen, becomes dissolved in the liquid phase at a saturation concentration related to the pressure and temperature of the container.

Another approach, where the GFX is a liquid or liquefied compressed gas, is to add propellant gas to the ullage space of an unpressurized agent container, except to the extent that the container is pressurized by the vapor pressure of the GFX contained therein, just before the need to dispense the agent from the container, specifically adding the propellant to the ullage space in the container above the agent liquid. The approach of adding propellant gas to the ullage space in a GFX container at the time of operation is sometimes referred to as the "piston-flow" approach, because the additional pressure energy contributed by the added propellant acts as a "piston" to force agent liquid into the pipe system via a siphon tube with an entrance near the bottom of the container. The piston-flow approach, when applied to a non-pre-pressurized GFX container delivers an agent free of nitrogen to the nozzle.

The approach described above may also be used to add additional propellant gas to a pre-pressurized container for the purpose of maintaining high pressure in the container during the discharge period

BRIEF DESCRIPTION OF THE INVENTION

According to one aspect of the invention, a system for delivery of a fire extinguishing agent includes an agent tank at least partially filled with liquid fire extinguishing agent at a pressure of substantially one atmosphere, or at vapor pressure of the agent contained therein, and a supply of pressurizing gas injectable into a volume of liquid agent in the agent tank. A discharge valve is configured to open when the agent tank reaches a desired pressure due to the injection of pressurizing gas therein thereby delivering a flow that includes fire extinguishing agent with associated dissolved pressurizing gas from the agent tank.

According to another aspect of the invention, a method for delivery of a fire extinguishing agent includes injecting a flow of pressurizing gas into a volume of fire extinguishing agent disposed in an agent tank. At least a portion of the pressurizing gas is dissolved into the liquid fire extinguishing agent. A pressure in the agent tank is increased to a selected level via the injection of the flow of pressurizing gas into the agent tank. A flow that includes fire extinguishing agent with associated dissolved pressurizing gas is discharged from the agent tank.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The FIGURE illustrates a schematic of an embodiment of a fire extinguishing system.

The detailed description explains embodiments of the invention, together with advantages and features, by way of example with reference to the drawing.

DETAILED DESCRIPTION OF THE INVENTION

A fire extinguishing system for conditioning and delivering a fire extinguishing agent includes an agent tank 12 at least partially filled with a volume of liquid fire extinguishing agent 14, a supply of pressurizing gas 16 operatively connected to inject pressurizing gas 16 into the volume of liquid agent 14, and a discharge valve configured to open when the agent tank 12 reaches a desired pressure due to the injection of pressurizing gas 16 therein thereby delivering a flow 42 including fire extinguishing agent 14 with associated dissolved pressurizing gas 16 from the agent tank.

The injection of the pressurizing gas 16 into the volume of liquid agent 14, is configured to achieve efficient gas-to-liquid contact to promote dissolution of the pressurizing gas 16 into the volume of liquid agent 14 in liquid phase and tends to promote equilibrium partitioning of the pressurizing gas between the gas phase 37 and liquid phase. At least a portion of the pressurizing gas 16 dissolves into the liquid agent 14. The portion of the pressurizing gas 16 not dissolved into the liquid agent 14 increases the pressure inside the agent tank 12. As pressurizing gas 16 continues to be added to the agent tank 12, the pressure in agent tank 12 increases with one result being that more of the pressurizing gas 16, which is being injected into the volume of liquid agent 14, dissolves in liquid agent 14.

According to one embodiment, the injection of the pressurizing agent 16 into the volume of liquid agent 14 forms a bubbly jet to promote dissolution of the pressurizing agent 16 in the liquid agent 14 and simultaneously pressurize the agent tank 12.

The FIGURE provides a schematic of an embodiment of a system 10 to condition and discharge a liquid fire-extinguishing agent. The system 10 includes an agent tank 12 at least partially filled with a fire extinguishing agent in liquid form 14, such as the perfluoroketone FK-5-1-12 (1,1,1,2,2,4,5,5,5-Nonafluoro-4-(trifluoromethyl)-3-pentanone) or the hydrofluorocarbon HFC-227ea (1,1,1,2,3,3,3-heptafluoropropane); the former agent is a low vapor pressure agent having a vapor pressure of about 4.9 psi and the latter agent is a high vapor pressure agent having a vapor pressure of about 58.8 psi, both at 70 degrees Fahrenheit. It is to be appreciated that any other suitable agent 14, including without limitation other halogenated materials, may be utilized. The agent 14 is stored at a pressure that is substantially one atmosphere or at its vapor pressure, whichever is greater, in the agent tank 12. A pressurizing gas 16, for example, nitrogen, is stored separately from the agent tank 12 at, for example, a gas tank 18. The gas supply 18 is connected to the agent tank 12 via a gas inlet valve (GIV) 20 which regulates the flow of pressurizing gas 16 into the agent tank 12. In some embodiments, the pressurizing gas 16 is stored at a pressure between 500 and 4500 psig.

The GIV 20 is connected to a gas inlet tube 22 which extends into the agent tank 12 and into the volume of liquid agent 14 to a point below a liquid surface 26 of agent 14. When the GIV 20 is opened, by for example, a control system 24 activated in the event of a fire or fire alarm, a flow of the pressurizing gas 16 flows from the gas tank 18, through the GIV 20, through the gas inlet tube 22 where it is expelled into the agent tank 12 below a top surface 26 of the liquid agent 14 contained in the agent tank 12. The injection of the pressurizing gas 16 below the surface 26 in this embodiment achieve efficient gas-to-liquid contact to promote dissolution of the pressurizing gas 16 into the agent 14 in liquid phase and tends to promote equilibrium partitioning of the pressurizing gas between the gas phase 37 and liquid phase. At least a portion of the pressurizing gas 16 dissolves into the liquid agent 14. The portion of the pressurizing gas 16 not dissolved into the agent 14 rises above the surface 26 and increases a pressure inside the agent tank 12. As pressurizing gas 16 continues to be added to the agent tank 12, the pressure in agent tank 12 increases with one result being that more of the pressurizing gas 16, which is being injected into the volume of liquid agent 14, dissolves in liquid agent 14. With the addition of pressurizing gas 16, the agent tank 12 pressure increases to a desired discharge pressure. At the discharge pressure, a pressure sensor 28 located at, for example, the GIV 20 communicates with a pressure operated actuator (POA) 30 which in turn, opens a discharge valve 32 at the agent tank 12.

The discharge valve 32 is connected on a first side 34 to a siphon tube 36 extending into the agent tank 12 below the surface 26 of the agent 14. The discharge valve 32 is connected at a second side 38 to a piping network 40. The piping network 40 is configured to distribute a flow 42 to a plurality of discharge nozzles 46 throughout a protected space 44. When the discharge valve 32 is opened by the POA 30, the pressure in the agent tank 12 urges flow 42 through the siphon tube 36 into the piping network 40 of a two-phase fluid comprising (a) liquid phase including liquid agent 14 with associated dissolved pressurizing gas 16, and (b) gas phase 37 including pressurizing gas 16 and agent vapor. The flow 42 proceeds through the piping network and is ejected from the plurality of discharge nozzles 46 as a fine mist that rapidly evaporates. As the agent 14 is discharged, additional pressurizing gas 16 may be introduced to the agent tank 12 via the GIV 20 to maintain the pressure in the tank 12 at or near a desired value. The presence of dissolved pressurizing gas 16 in the stream at the nozzle 46 promotes improved atomization of agent 14.

The system 10 described herein has advantages including the ability to maintain pressurizing gas 16 delivery to the agent tank 12 to maintain a high pressure throughout the period of agent 14 discharge and to achieve pressurizing gas 16 dissolution in the liquid phase of agent 12 simultaneously with the event of pressurizing agent tank 12. The high tank pressure facilitates high nozzle pressure which, coupled with achieving a sufficient degree of pressurizing gas dissolution in the liquid phase of agent 12, facilitates efficient liquid atomization at the plurality of discharge nozzles 46 which in turn facilitates liquid vaporization in the atmosphere of the protected space 44. Increased atomization, in turn, enhances the rate of evaporation of the flow 42 when discharged from the nozzles 46 to create a desired fire extinguishing atmosphere. Further increased pressure, and the ability to maintain the pressure through the period of agent 14 discharge results in a system 10 where a length of the piping network 40 may be increased, compared to a system utilizing a container containing only nitrogen to pressurize the agent present in the tank. Further, because the agent tank 12 is initially not pre-pressurized by a pressurizing gas, and only pressurized by a pressurizing gas 16 at the time of use, agent tanks 12 may not need to be transported as hazardous goods.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described features in the embodiments. Accordingly, the invention is not to be seen as limited by the foregoing description, but is only limited by the scope of the appended claims.

The invention claimed is:

1. A system for delivery of a fire extinguishing agent comprising:

an agent tank at least partially filled with a volume of liquid fire extinguishing agent;

a gas inlet tube extending into the agent tank from above a liquid surface of the liquid fire extinguishing agent to below the liquid surface of the fire extinguishing agent to inject a supply of pressurizing gas operatively connected to inject pressurizing gas into the volume of liquid agent below the liquid surface of the liquid agent during operating of the system, the gas inlet tube expelling the pressurizing gas such that a first portion of the pressurizing gas is dissolved into the liquid fire extinguishing agent and a second portion of the pressurizing gas not dissolved in the liquid fire extinguishing agent pressurizes the agent tank;

a discharge valve disposed at the agent tank configured to open when the agent tank reaches a desired pressure due to the injection of pressurizing gas therein thereby delivering a two-phase flow including:

a liquid phase including liquid fire extinguishing agent and associated dissolved pressurizing gas; and a gas phase including pressurizing gas and fire extinguishing agent vapor;

a gas inlet valve disposed on the agent tank configured to continue providing the supply of pressurizing gas into the agent tank after opening of the discharge valve, the gas inlet tube extending downwardly from the gas inlet valve into the agent tank; and a pressure-operated valve actuator in operable communication with the agent tank and with the discharge valve;

wherein the pressure-operated valve actuator is configured to open the discharge valve when a pressure sensor disposed at the gas inlet valve indicates that a pressure in the agent tank reaches a selected level.

2. The system of claim 1, wherein the fire extinguishing agent is a low vapor pressure fire extinguishing agent.

3. The system of claim 2, wherein the fire extinguishing agent is a low vapor pressure liquid.

4. The system of claim 1, wherein the fire extinguishing agent is a high vapor pressure fire extinguishing agent.

5. The system of claim 4, wherein the fire extinguishing agent is a hydrofluorocarbon.

6. The system of claim 1, further comprising one or more discharge nozzles operably connected to the discharge valve to receive the flow of fire extinguishing agent with associated dissolved pressurizing gas and deliver the agent into a protected space.

7. The system of claim 6, wherein the discharge valve is connected to the one or more discharge nozzles via a piping network.

8. The system of claim 1, wherein injection of the pressurizing gas into the volume of agent in the agent tank is activated upon sensing of a fire event.

9. The system of claim 1, further comprising a siphon tube operably connected to the discharge valve and extending from the discharge valve downwardly into the agent tank.

10. The system of claim 9, wherein the siphon tube extends below the liquid surface of the fire extinguishing agent.

11. The system of claim 1, wherein the pressurizing gas is nitrogen.

12. The system of claim 1, where the pressurizing gas is argon.

13. The system of claim 1, where the pressurizing gas is a mixture containing two or more of the species nitrogen, argon, and carbon dioxide.

14. The system of claim 1, where the injection of the pressurizing agent into the volume of liquid agent is configured to form a bubbly jet.

15. The system of claim 1, further comprising a gas tank configured to store the pressurizing gas.

16. A method for delivery of a fire extinguishing agent comprising:

injecting a flow of pressurizing gas into a volume of liquid fire extinguishing agent disposed in an agent tank below a liquid surface of the liquid fire extinguishing agent via a gas inlet tube extending into the agent tank from above the liquid surface of the liquid fire extinguishing agent to below the liquid surface of the fire extinguishing agent, the flow of pressurizing gas injected into the agent tank through a gas inlet valve disposed on the agent tank and through the gas inlet tube extending downwardly from the gas inlet valve;

dissolving a first portion of the pressurizing gas into the liquid agent;

increasing a pressure in the agent tank to a selected level via a second portion of the pressurizing gas not dissolved into the liquid agent;

discharging a two-phase flow from the agent tank via a discharge valve disposed at the agent tank, the two-phase flow including:

a liquid phase including liquid fire extinguishing agent and associated dissolved pressurizing gas; and a gas phase including pressurizing gas and fire extinguishing agent vapor; and continuing to inject the flow of pressurizing gas into the volume of liquid agent after an initial discharge of the two-phase flow;

wherein the discharge valve is opened via a pressure-operated valve actuator in operable communication with the agent tank and with the discharge valve, the pressure-operated valve actuator configured to open the discharge valve when a pressure sensor disposed at the gas inlet valve indicates that a pressure in the agent tank reaches a selected level.

17. The method of claim 16, wherein the continued injection of pressurizing gas into the agent tank maintains the pressure in the agent tank at or above the selected level.

18. The method of claim 16, wherein the flow of fire extinguishing agent and pressurizing gas is discharged via the opening of a discharge valve operably connected to the agent tank.

19. The method of claim 18, wherein the discharge valve is opened via a pressure operated actuator operably connected to the discharge valve and the agent tank.

20. The method of claim 16, further comprising discharging the flow of fire extinguishing agent and associated dissolved pressurizing gas through one more discharge nozzles into a protected space.

21. The method of claim 20, further comprising discharging the flow of fire extinguishing agent and pressurizing gas from the plurality of nozzles via a piping network.

22. The method of claim 16, further comprising evaporating the flow of fire extinguishing agent in the protected space.

23. The method of claim 16, further comprising discharging the flow of fire extinguishing agent and associated dissolved pressurizing gas from the agent tank via a siphon tube operably connected to the discharge valve.

24. The method of claim 23, wherein the siphon tube removes fire extinguishing agent and associated dissolved pressurizing gas from the agent tank from below a surface of the fire extinguishing agent.

25. The method of claim 16, further comprising injecting the pressurizing gas from a gas tank.

26. The method of claim 16, wherein the pressurizing gas is nitrogen, argon, or mixtures of two or more of the species nitrogen, argon, and carbon dioxide.

27. The method of claim 16, further comprising injecting the pressurizing gas into the volume of agent in the agent tank upon a sensing of a fire event.

28. The method of claim 16, further comprising the injection of the pressurizing agent into the volume of liquid agent forms a bubbly jet.

* * * * *